US011919088B1

(12) United States Patent
Crutchfield et al.

(10) Patent No.: US 11,919,088 B1
(45) Date of Patent: Mar. 5, 2024

(54) PRESSURE ASSISTED MELT INFILTRATION

(71) Applicants: Rolls-Royce Corporation, Indianapolis, IN (US); Rolls-Royce High Temperature Composites Inc., Cypress, CA (US)

(72) Inventors: Jeffrey Crutchfield, Indianapolis, IN (US); Andrew Ritchey, Cypress, CA (US)

(73) Assignees: ROLLS-ROYCE HIGH TEMPERATURE COMPOSITES INC., Cypress, CA (US); ROLLS-ROYCE CORPORATION, Indianapolis, IN (US)

( * ) Notice: Subject to any disclaimer, the term of this patent is extended or adjusted under 35 U.S.C. 154(b) by 98 days.

(21) Appl. No.: 17/576,303

(22) Filed: Jan. 14, 2022

Related U.S. Application Data

(60) Provisional application No. 63/293,292, filed on Dec. 23, 2021.

(51) Int. Cl.
*B22F 7/08* (2006.01)

(52) U.S. Cl.
CPC ..... *B22F 7/08* (2013.01); *B22F 2201/016* (2013.01); *B22F 2201/02* (2013.01); *B22F 2201/20* (2013.01); *B22F 2302/105* (2013.01)

(58) Field of Classification Search
CPC ..... B22F 7/08; B22F 7/00; B22F 7/06; B22F 2007/066; B22F 1/062; B22F 3/002; C04B 35/622; C04B 35/626; C04B 35/653; C04B 41/4584; C04B 41/51; C04B 41/5177; C04B 20/1014; C04B 2235/616
See application file for complete search history.

(56) References Cited

U.S. PATENT DOCUMENTS

| | | | | |
|---|---|---|---|---|
| 5,111,871 | A * | 5/1992 | Cook | B22D 19/14 164/63 |
| 5,628,938 | A | 5/1997 | Sangeeta et al. | |
| 5,817,432 | A | 10/1998 | Chwastiak et al. | |
| 6,503,572 | B1 | 1/2003 | Waggoner et al. | |
| 2004/0191411 | A1 | 9/2004 | Hornor et al. | |
| 2006/0163773 | A1 | 7/2006 | Gray | |
| 2013/0287941 | A1 | 10/2013 | Gray | |
| 2021/0155558 | A1 | 5/2021 | Bortoluzzi et al. | |

* cited by examiner

*Primary Examiner* — Ricardo D Morales
(74) *Attorney, Agent, or Firm* — Crowell & Moring LLP

(57) ABSTRACT

Methods of pressure assisted melt infiltration of fiber preforms are provided. The fiber preform is provided inside of a pressure vessel. The pressure vessel projects into a molten material contained in a crucible. The pressure vessel has an opening located below a surface of the molten material through which the molten material enters the pressure vessel. An end of the fiber preform contacts the molten material within the pressure vessel. The pressure vessel and crucible are located in a furnace. The molten material is pulled within the pressure vessel by increasing a first pressure at a first port of the furnace so the first pressure is higher than a second pressure at a second port of the pressure vessel. The second port is located above the molten material located within the pressure vessel. The fiber preform is infiltrated with the molten material.

14 Claims, 9 Drawing Sheets

PRESSURE ASSISTED MELT INFILTRATION

CROSS-REFERENCE TO RELATED APPLICATIONS

This application claims priority to U.S. Provisional Application No. 63/293,292, filed Dec. 23, 2021, the entire content of which is incorporated herein by reference.

TECHNICAL FIELD

This disclosure relates to the manufacture of ceramic matrix composites (CMCs) and, in particular, to a melt infiltration process for CMCs.

BACKGROUND

Present melt infiltration processes suffer from a variety of drawbacks, limitations, and disadvantages. Accordingly, there is a need for inventive systems, methods, components, and apparatuses described herein.

BRIEF DESCRIPTION OF THE DRAWINGS

The embodiments may be better understood with reference to the following drawings and description. The components in the figures are not necessarily to scale. Moreover, in the figures, like-referenced numerals designate corresponding parts throughout the different views.

DETAILED DESCRIPTION

Figure 1A:
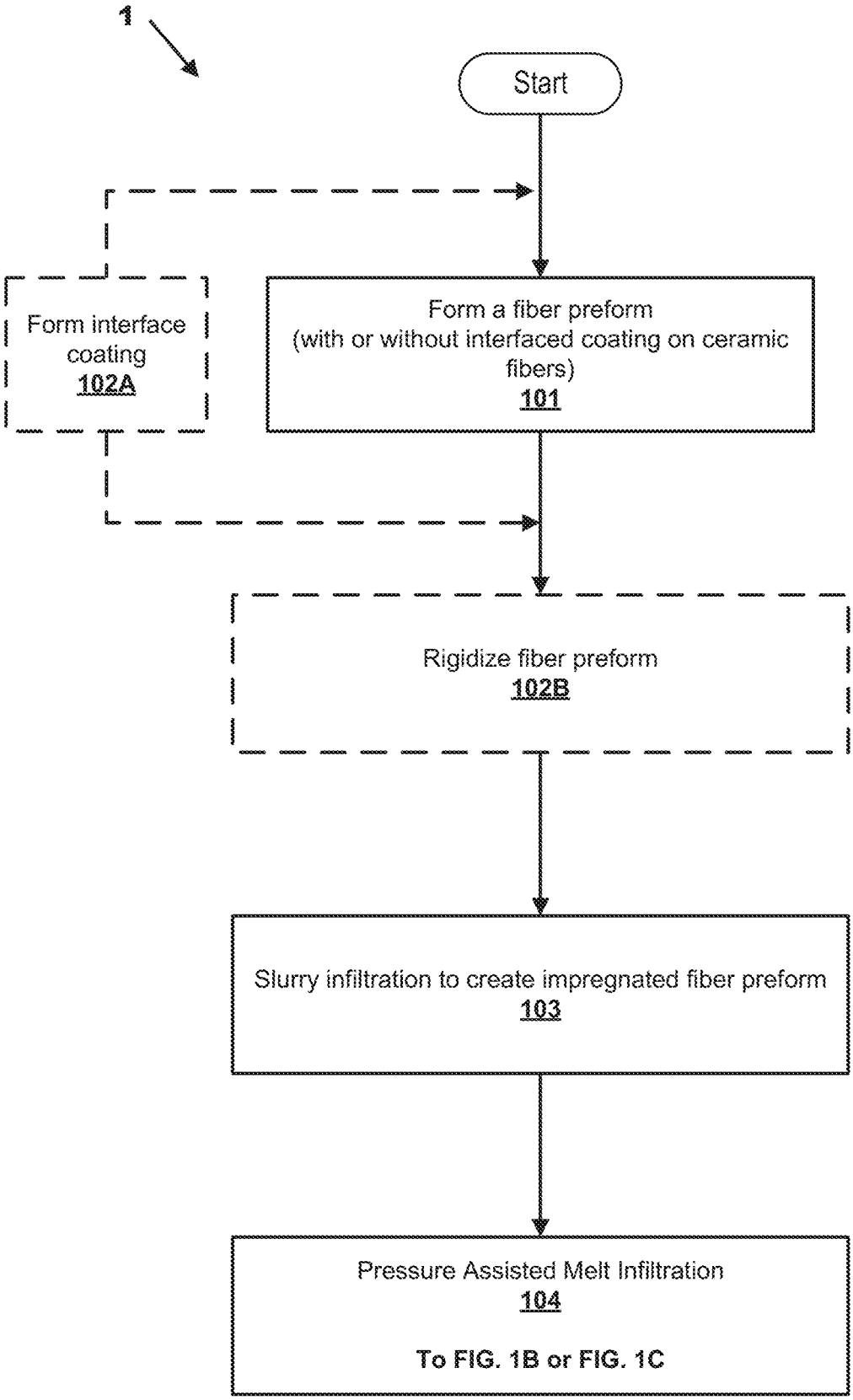
FIG. 1A is a flowchart of an example method for forming a ceramic matrix composite (CMC) article.

Producing a ceramic matrix composite (CMC) article, including, without limitation, silicon carbide matrix (SiC: SiC) composite articles may include multiple steps. For example: forming a ceramic fiber preform; optionally, rigidizing the ceramic fiber preform with a fiber interphase coating via a Chemical Vapor Infiltration (CVI) process, infiltrating a ceramic slurry into the porous body or preform, optionally, conducting one or more secondary operations, and subsequently, melt infiltrating the preform with molten silicon or a silicon alloy to form the CMC article.

The present subject matter discloses an improved melt infiltration process that may reduce the time required for silicon infusion, may improve the surface finish, and/or may allow for a greater proportion of carbon to be utilized in the slurry infiltrant to reduce the proportion of free silicon in the finished article.

The present subject matter discloses a method of melt infiltrating a fiber preform. The fiber preform is provided inside of a pressure vessel. The pressure vessel projects into a molten material contained in a crucible. The pressure vessel has an opening located below a surface of the molten material through which the molten material enters the pressure vessel. An end of the fiber preform contacts the molten material within the pressure vessel. The pressure vessel and crucible are located in a furnace. The molten material is pulled within the pressure vessel by increasing a first pressure at a first port of the furnace so the first pressure is higher than a second pressure at a second port of the pressure vessel. The second port is located above the molten material located within the pressure vessel. The fiber preform is infiltrated with the molten material.

The present subject matter discloses a method of melt infiltrating a fiber preform. While the fiber preform is surrounded by a molten material, a pressure on the molten material is increased to above an ambient atmospheric pressure. The increased pressure acts to more completely fill the porosity within the preform and increase the rate at which infiltration proceeds.

The present subject matter discloses a method of melt infiltrating a fiber preform. A fiber preform is provided inside of a pressure vessel. The pressure vessel projects into a molten material contained in a crucible. The pressure vessel has an opening located below a surface of the molten material through which the molten material enters the pressure vessel. An end of the fiber preform contacts the molten material within the pressure vessel. The pressure vessel and crucible are located in a furnace. The molten material is pulled within the pressure vessel vertically higher in the pressure vessel to cover the fiber preform with the molten material by increasing a first pressure at a first port of the furnace so the first pressure is higher than a second pressure at a second port of the pressure vessel and higher than the vapor pressure of the molten material. The second port is located above the molten material located within the pressure vessel. The second pressure at the second port and the first pressure at the first port are increased while the fiber preform is covered with the molten material. The first pressure and the second pressure are increased to at least an ambient atmospheric pressure or greater to a matching pressure. The fiber preform is infiltrated with the molten material to react with a portion of the fiber preform and to form a reaction product within the fiber preform.

One interesting feature of the methods described below may be that a greater proportion of carbon may be utilized in the fiber-reinforced matrix composite preform or green body while reducing the likelihood of choking the melt infiltration. Choking may occur when excessive solids are formed during the melt infiltration that blocks the flow of additional molten material to the choked portions of the fiber preform/green body 210, thus causing areas of decreased strength in the finished article. Another interesting feature of the disclosed methods, as previously discussed, is the substantial time savings in melt infiltrating a fiber-reinforced matrix composite preform or green body versus the melt infiltration processes of the prior art.

The following description is merely exemplary in nature and is in no way intended to limit the present disclosure or the application or use thereof.

For the purpose of this disclosure the terms "about" and "substantially" are used herein with respect to measurable values and ranges due to expected variations known to those skilled in the art (e.g., limitations and variability in measurements).

For the purpose of this disclosure, the terms "at least one" and "one or more of" an element are used interchangeably and may have the same meaning. These terms, which refer to the inclusion of a single element or a plurality of the elements, may also be represented by the suffix "(s)" at the end of the element. For example, "at least one source", "one or more sources", and "source(s)" may be used interchangeably and are intended to have the same meaning.

For the purpose of this disclosure, the term "temperature control" describes controlling a temperature with limited variation, such as +5° C.; alternatively, ±3° C.; alternatively, ±1° C.; alternatively, ±0.5° C. When desirable, this control over the variation in temperature may also be expressed as a percentage of the measured temperature. For example, as the measured temperature is controlled to be within ±10%; alternatively, ±5%; alternatively, 3%; alternatively, ±1%.

The recitations of numerical ranges by endpoints include the endpoints and all numbers within that numerical range. For example, a concentration ranging from 40% by volume to 60% by volume includes concentrations of 40% by volume, 60% by volume, and all concentrations there between (e.g., 40.1%, 41%, 45%, 50%, 52.5%, 55%, 59%, etc.).

For the purpose of this disclosure, all described pressure values are absolute.

For purposes of promoting an understanding of the principles of the present disclosure, reference will now be made to the embodiments illustrated in the drawings, and specific language will be used to describe the same. It should be understood that throughout the description, corresponding reference numerals indicate like or corresponding parts and features. One skilled in the art will further understand that any properties reported herein represent properties that are routinely measured and may be obtained by multiple different methods. The methods described herein represent one such method and other methods may be utilized without exceeding the scope of the present disclosure.

No limitation of the scope of the present disclosure is intended by the illustration and description of certain embodiments herein. In addition, any alterations and/or modifications of the illustrated and/or described embodiment(s) are contemplated as being within the scope of the present disclosure. Further, any other applications of the principles of the present disclosure, as illustrated and/or described herein, as would normally occur to one skilled in the art to which the disclosure pertains, are contemplated as being within the scope thereof.

FIG. 1A illustrates an example method 1 of forming a CMC article using pressure-assisted melt infiltration. The method may comprise forming and processing the fiber preform in step 101. The fiber preform may comprise a three-dimensional framework of ceramic fibers. The framework may be formed by, in one example, laying up plies comprising tows of ceramic fibers arranged in a two- or three-dimensional weave. The method may further comprise, before or after forming the framework, optionally forming an interface coating on the ceramic fibers in step 102A to provide a weak fiber-matrix interface once the CMC is formed, which can be beneficial for fracture toughness. After forming the fiber preform, a matrix material such as silicon carbide may be deposited on the ceramic fibers via chemical vapor infiltration or another deposition process known in the art to form a rigidized fiber preform in optional step 102B. In step 103, the fiber preform (typically the rigidized fiber preform) may be infiltrated with a slurry comprising ceramic particles and optionally reactive elements/particles to form an impregnated fiber preform, i.e., a fiber preform loaded with particulate matter (ceramic and optionally other particles) in a process that may be referred to as slurry infiltration. The impregnated fiber preform may in some examples comprise a loading level of particulate matter from about 40 vol. % to about 60 vol. %, with the remainder being porosity. The method may further comprise infiltrating the fiber preform with a molten material in step 104 in a process that may be referred to as melt infiltration, which is further described with reference to FIGS. 1B and 1C. The melt infiltration step 104 may be followed by cooling, thereby forming a ceramic matrix composite. The molten material infiltrated into the fiber preform (which may be a rigidized and/or impregnated fiber preform as described above) may consist essentially of silicon (e.g., elemental silicon and any incidental impurities) or may comprise a silicon-rich alloy. Melt infiltration may be carried out at a temperature at or above the melting temperature of silicon or the silicon alloy which is infiltrated. Thus, the temperature for melt infiltration is typically in a range from about 1350° C. to about 1500° C. A suitable time duration for melt infiltration may be from 15 minutes to four hours, for example, depending in part on the size and complexity of the ceramic matrix composite to be formed. A ceramic matrix is formed from ceramic particles as well as ceramic reaction products created from the reaction between the molten material and any other reactive elements (e.g., carbon particles, refractory metal particles) in the fiber preform. Typically, the ceramic matrix comprises silicon carbide, but may also or alternatively comprise silicon oxycarbide, silicon nitride, alumina, aluminosilicate, and/or boron carbide or another refractory carbide. The ceramic fibers that serve as the framework of the fiber preform typically comprise silicon carbide, but may also or alternatively comprise another ceramic, such as silicon nitride, alumina, or aluminosilicate, or carbon. In some examples, the ceramic matrix composite may include a silicon carbide matrix and silicon carbide ceramic fibers, and may be referred to as a SiC/SiC composite. The ceramic matrix composite may form part or all of a component of a gas turbine engine, such as a turbine blade or vane. The method of forming the CMC article using pressure-assisted melt infiltration may include additional, fewer, or different steps than illustrated in FIG. 1A.

Figure 1B:
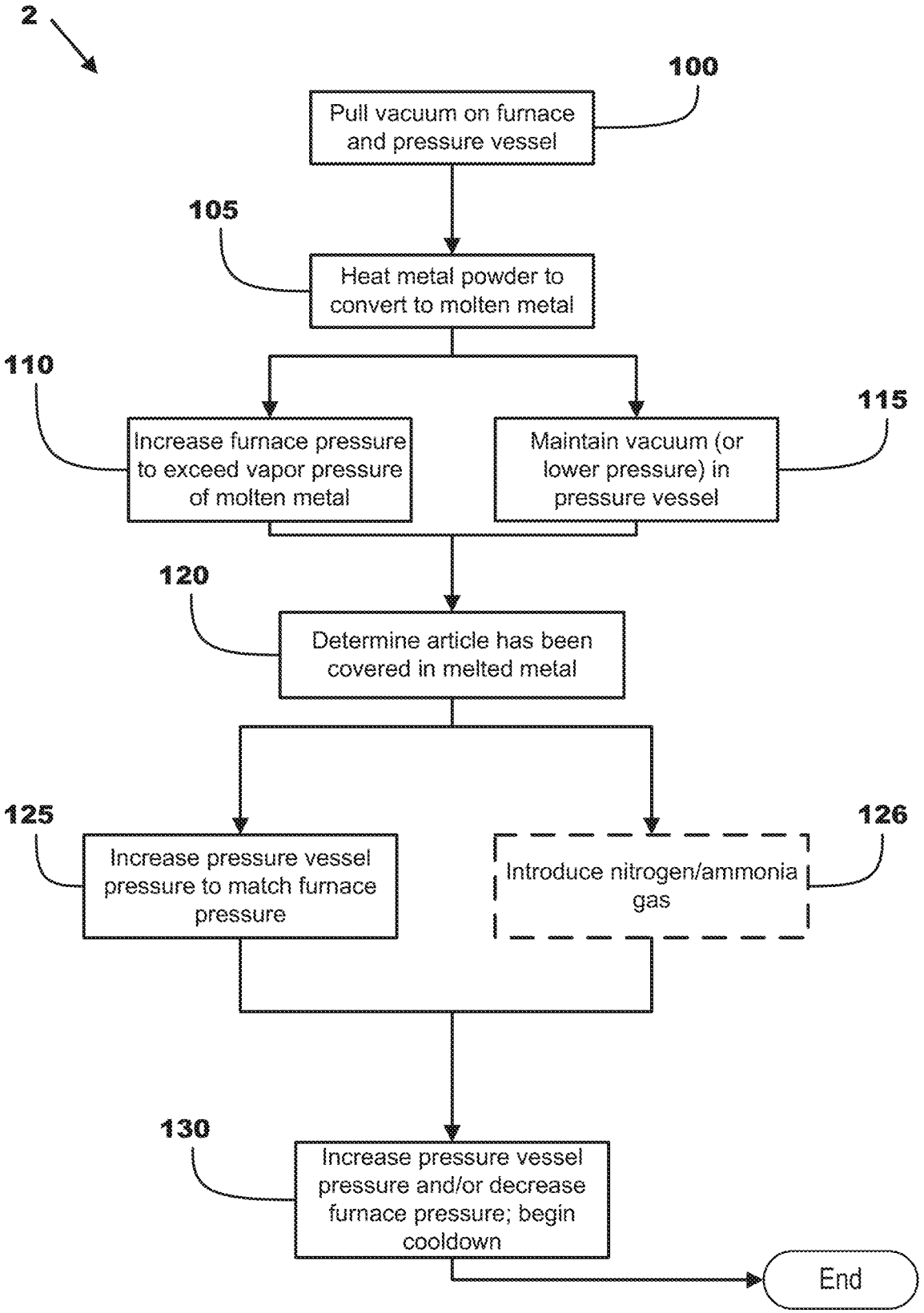
FIG. 1B is a flowchart of an example method for melt infiltrating a ceramic matrix composite (CMC) article.

FIG. 1B illustrates steps of a method in which molten a metal or metal alloy is infiltrated into any porosity that remains or is still present in the fiber preform. After completion of any optional secondary processing operations in step 40, a molten metal or metal alloy is infiltrated into the fiber-reinforced matrix composite preform or green body. This molten metal or metal alloy occupies any remaining interstices that may be present between the solid particulate fillers and ceramic fibers until the green body is fully densified to less than about 7% porosity; alternatively, 5% porosity; alternatively, less than about 3% porosity; alternatively, between 0% and about 1% porosity in the finished CMC article. The method of pressure-assisted melt infiltration may include additional, fewer, or different steps than illustrated in FIG. 1A.

As used herein the term "metal or alloy" is intended to refer to a matrix infiltrant, which may comprise any number of materials. Several specific examples of metals that may be used to infiltrate the fiber preform may comprise, without limitation, aluminum, silicon, nickel, titanium, or mixtures and alloys thereof. Alternatively, the metal or metal alloy infiltrant is silicon, silicon carbide, silicon nitride, or a combination thereof (e.g., silicon/silicon carbide, etc.). When desirable, the metal or metal alloy particles may be combined with other additives or process aids.

Figure 2A:
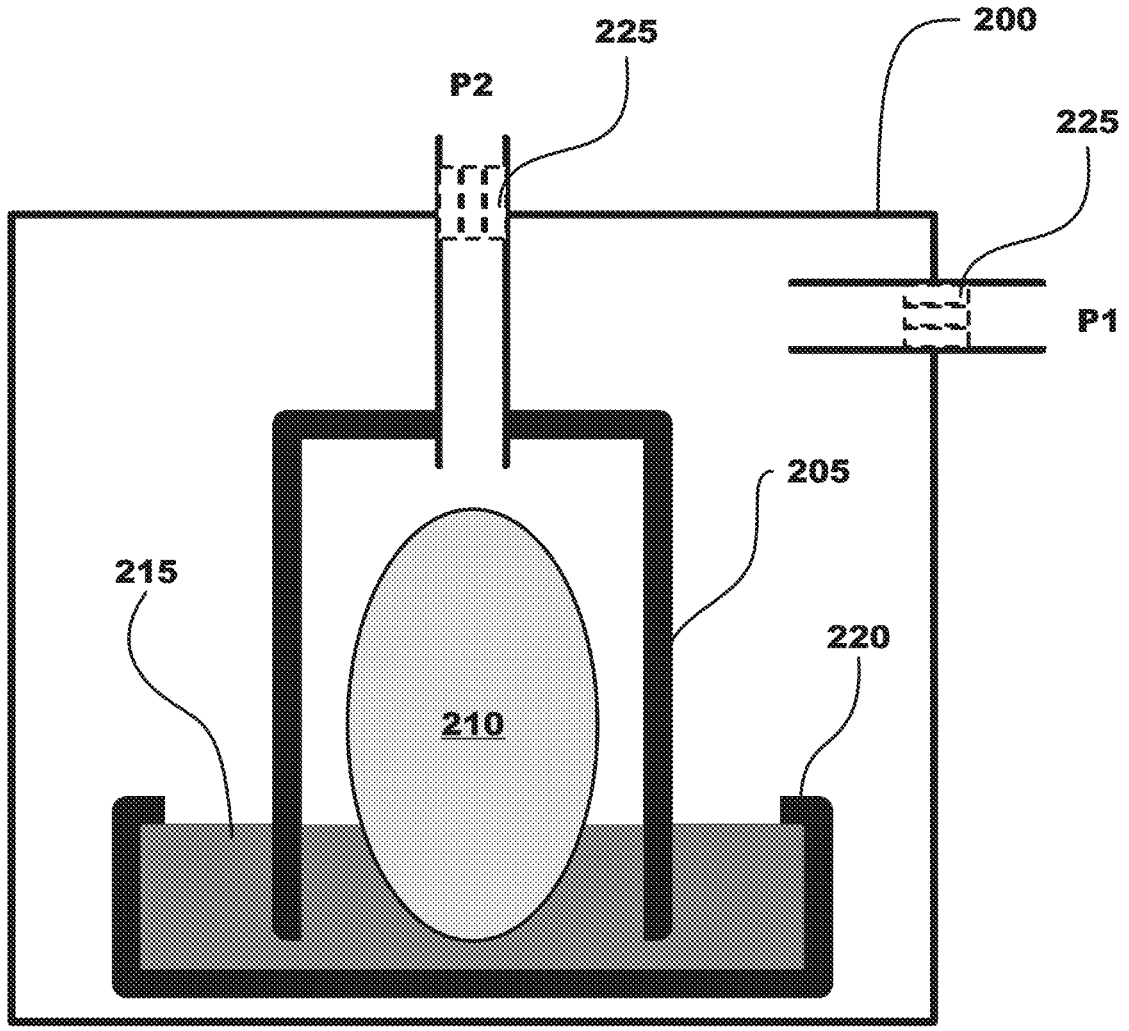
FIG. 2A is a schematic representation of an example stage of a melt infiltration process.
Figure 2B:
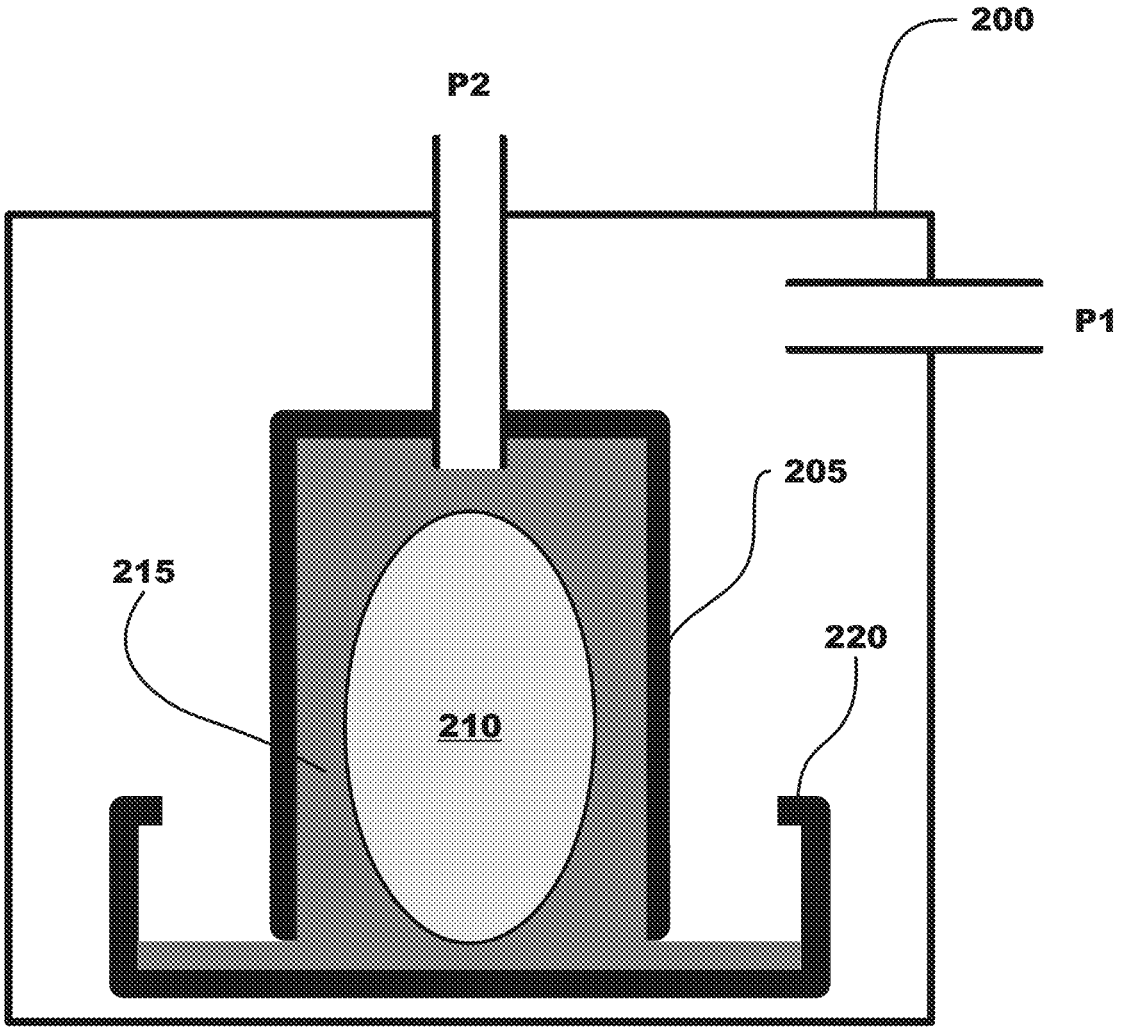
FIG. 2B is a schematic representation of an example stage of a melt infiltration process.
Figure 2C:
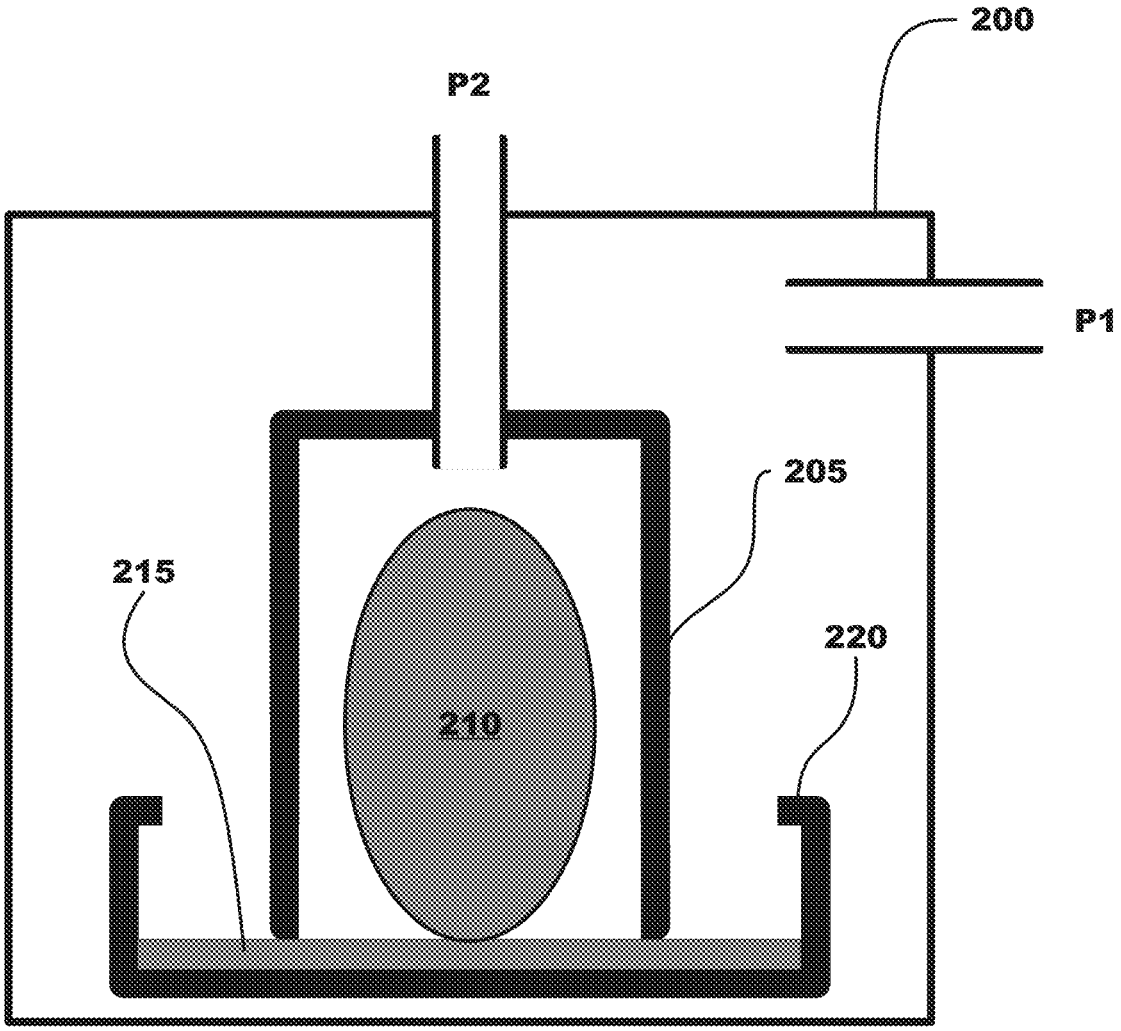
FIG. 2C is a schematic representation of an example stage of a melt infiltration process.

With further reference to FIGS. 2A-2C, which show schematic illustrations of various stages of pressure-assisted melt infiltration methods, after removing the fiber preform or green body 210 from the pliable container in step 38, the fiber preform or green body 210 may be placed in a pressure vessel 205 within a furnace 200. The pressure vessel 205 may be disposed within a tray or crucible 220. The tray/crucible 220 and pressure vessel 205 may be disposed in the furnace 200. The furnace 200 may have at least two ports P1 and P2. The first port P1 may be connected directly to an interior volume of the furnace 200. The second port P2 may be connected directly to an interior volume of the pressure vessel 205. Within the tray/crucible 220, a metal powder such as silicon may be disposed. One or more of the first and second ports P1/P2 may include a device 225, such as a filter, valve, or trap to prevent molten metal from being evacuated.

The furnace 200 may be any suitable enclosure capable of generating sufficient heat to melt the metal powder 215. The furnace 200 may include electrical resistance elements and utilize induction and/or direct heating. The furnace 200 may be of a programmable-type capable of carrying out a programmed heating schedule. The furnace 200 may further include a control system (not shown) to monitor an internal temperature in real-time to cycle the heating components as needed to maintain a programmed temperature, for example, using PID control. Furnace 200 may include a first port P1 to which pressurizing/depressurizing equipment (not shown) may be attached. For instance, the first port P1 may be connected to various plumbing and storage tank components to apply a wide range of positive and negative pressures to the furnace 200. For instance, the furnace 200 may be capable of holding pressures ranging between full vacuum (≤100 mTorr) to approximately 38 kTorr.

The pressure vessel 205 may be any container suitable for withstanding the melting temperatures of the metal powder 215 and pressures described herein. In the case of using silicon powder, for instance, the pressure vessel is be capable of withstanding at least 1500° C. or greater. The pressure vessel 205 may be disposed partly in a bed of metal powder 215, which is disposed within the tray/crucible 220. The pressure vessel 205 may include the second port P2, which, like the first port P1, may be connected to various plumbing and storage tank components to apply a wide range of positive and negative pressures to the pressure vessel 205. The second port P2 may provide a path to the exterior of the furnace 200 to allow for connecting the pressurizing/depressurizing equipment directly to the pressure vessel 205 such that the interior of the furnace 200 is bypassed.

The fiber preform/green body 210 may be either a fiber preform or a green body; the difference being that the fiber preform may be converted to a green body through infiltration with a ceramic slurry, as previously discussed with respect to steps 20 and 30-38 of FIG. 1A. As also previously discussed, converting the fiber preform to a green body is optional and the melt infiltration process disclosed herein with reference to FIG. 1B is equally applicable to the non-rigid fiber preform or the rigid green body forms alike.

Metal powder 215 may be any metal suitable to be infiltrated into the fiber preform/green body 210 provided in a powdered format. The metal powder 215 may be disposed in a tray or crucible 220. In an example, the metal powder 215 may be silicon powder. Melt infiltration of the silicon powder into the fiber preform/green body 210 may react with carbon present in the fiber preform/green body 210 to form silicon carbide. The pressure vessel 205 and/or the fiber preform/green body 210 may be at least partially disposed within the bed of metal powder 215. For instance, the pressure vessel 205 may partially extend into the bed of metal powder 215.

A device 225 may be included within one or more of the first and second ports P1/P2 to prevent the molten metal; that is, the molten material 215 from being evacuated during the pressurization/depressurization processes. The device 225 may be a filter, an on/off valve, a check valve, a trap, or the like.

Referring back to FIG. 1B, in step 100 of method 2 a negative pressure, preferably a vacuum of 100 mTorr or less, may be applied to the ports P1/P2 of the furnace 200 and pressure vessel 205. Simultaneously with step 100 or subsequently thereafter, the furnace 200 may begin to heat in step 105 in preparation for melting the metal powder 215. By applying an approximate vacuum of 100 mTorr or less, a substantially combustion-free and oxidation-free environment may be established within the interior of the furnace 200. In step 105, it may also be determined that the metal powder 215 has melted. The determination in step 105 may occur, for example, based on user observation, expiration of a predetermined timer value, a thermometer threshold reading, and the like. This step is schematically illustrated in FIG. 2A.

In step 110, with most or all of the metal powder 215 in molten form, the furnace pressure may be increased via port P1 to meet or exceed a vapor pressure of the molten material 215, such as at least 5 to 10 mTorr or greater while the vacuum (≤100 mTorr) is maintained 115 on port P2 to force the molten material 215 to propagate vertically from the tray/crucible 220 through the pressure vessel 205 to completely cover the fiber preform/green body 210. During step 110, the furnace pressure at port P1 may be greater than the pressure vessel pressure at port P2, where the maximum pressure at port P1 may be 100 mTorr or less and the minimum pressure at port P2 may be 5 mTorr. It may not be strictly necessary for vacuum to be maintained on the second port P2 connected to the pressure vessel 205 to cause the molten material 215 to propagate. Rather a pressure differential determined based on the cross-sectional area available to the first and second ports P1/P2, such that P1>P2, may be sufficient to cause the molten material 215 to propagate and cover the fiber preform/green body 210 to a desired height within the pressure vessel 205. This step is schematically illustrated in FIG. 2B. The desired pressure P2 may be determined by balancing the force of gravity acting on the molten material 215 against the pressure differential applied at ports P1 and P2, such that:

$$P2_{pressure}=(P1_{pressure}*A1-\rho*g*h)/A2$$

where A1 is the cross-sectional area of the molten material 215 silicon outside pressure vessel 205 within the crucible 220, A2 is the cross-sectional area of the molten material 215 inside pressure vessel 205, ρ is the density of the molten material 215, g is the acceleration due to gravity, and h is the desired height within the pressure vessel 205.

In step 120, it may be determined whether the fiber preform/green body 210 has been completely covered by the molten material 215. This may be determined based on user observation and/or the expiration of a predetermined timer value based on the volume inside of the pressure vessel 205 and the overall volume of the furnace 200. Alternatively, or in addition, a control system (not shown) may be employed that computes, based on one or more of the temperature of the molten material 215 or a viscosity graph of the molten material 215, a minimum time duration needed to cover the fiber preform/green body 210.

Once it has been determined that the fiber preform/green body 210 has been covered in metal in step 120, the pressure applied to the second port P2 may be increased to substantially match the furnace 200 pressure applied to the first port P1 in step 125, where the pressure applied to ports P1 and P2 is greater than an ambient atmospheric pressure. Alternatively, or in addition, the furnace 200 pressure applied to port P1 may be reduced. The purpose of this step is to encourage infiltration of the molten material 215 into the pores of fiber preform/green body 210. This step is schematically illustrated in FIG. 2C.

Optionally, a step 126 may occur simultaneously with step 125 where nitrogen and/or ammonia gas may be introduced via one or more of the first or second ports P1/P2. Introducing the nitrogen and/or ammonia gas may change the wetting angle of the silicon to encourage excess silicon to bread-up and roll from the finished article.

In step 130, the pressure applied to the second port P2 may be increased and/or the pressure applied to the first port P1 may be decreased until the pressure is equilibrated such that the remaining molten silicon returns to its minimum height. This may help to force residual silicon from the fiber preform/green body 210 to improve the surface finish, to return residual silicon to the tray/crucible 220, and to prepare for melt infiltrating subsequent fiber preforms/green bodies 210. Step 130 also begins the cooldown process for furnace 200.

Figure 1C:
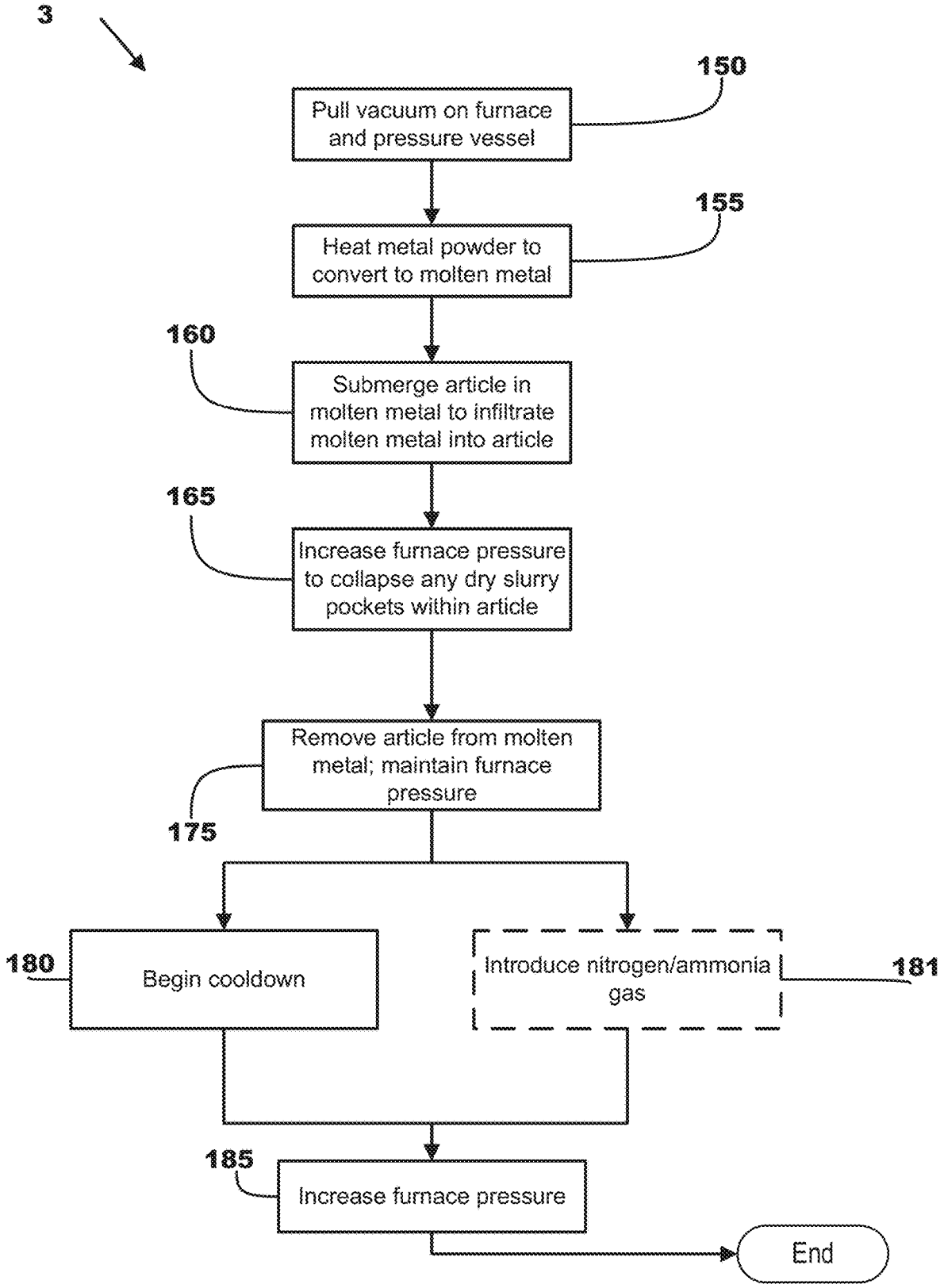
FIG. 1C is a flowchart of an example method for melt infiltrating a ceramic matrix composite (CMC) article.
Figure 3A:
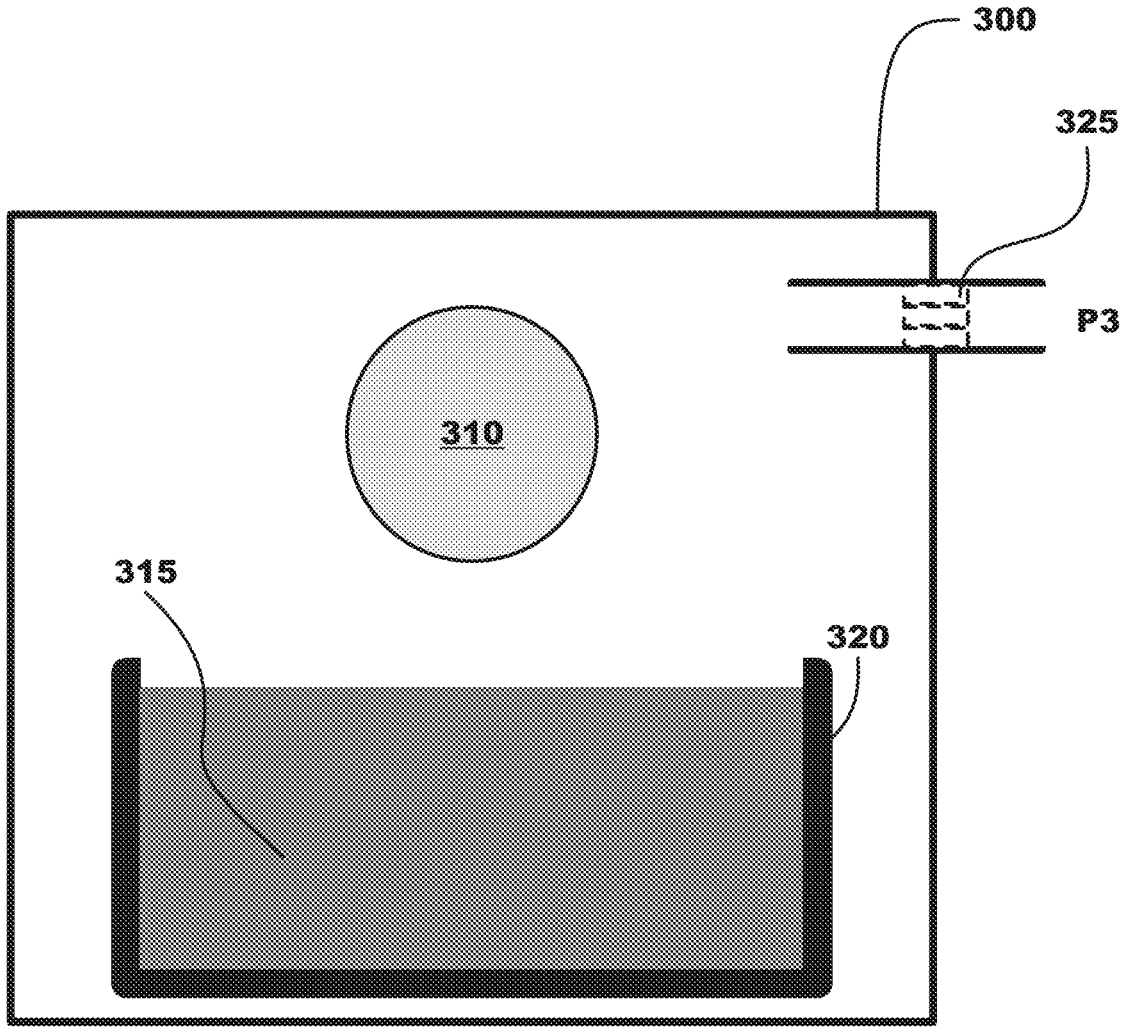
FIG. 3A is a schematic representation of an example stage of a melt infiltration process.
Figure 3B:
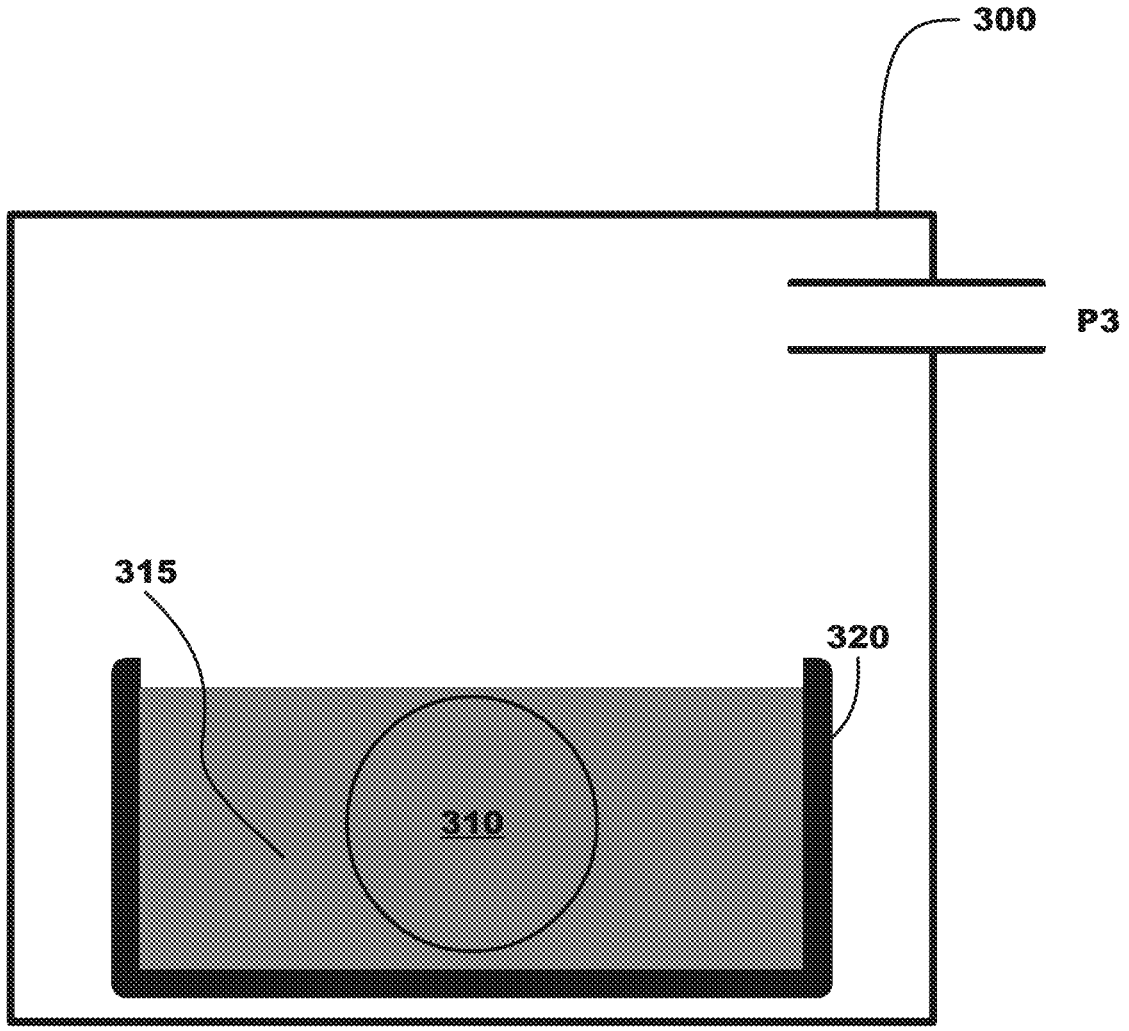
FIG. 3B is a schematic representation of an example stage of a melt infiltration process.
Figure 3C:
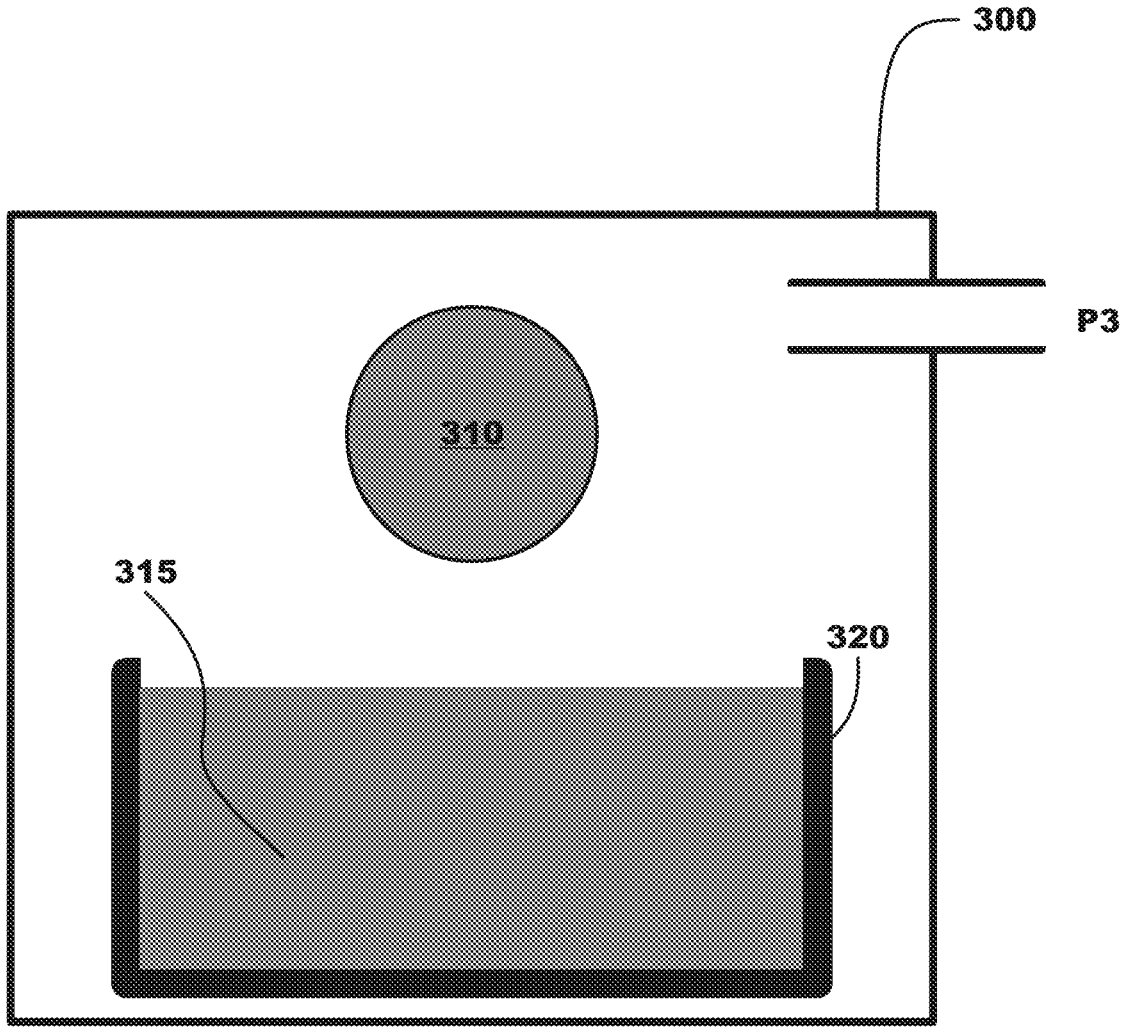
FIG. 3C is a schematic representation of an example stage of a melt infiltration process.

FIG. 1C shows an example method 3 of melt infiltrating a fiber-reinforced matrix composite preform or green body. With further reference to FIGS. 3A-3C, which show schematic illustrations of various stages of the method 3, after removing the fiber preform or green body 310 from the pliable container in step 38, the fiber preform/green body 310 may be placed within a furnace 300. A tray/crucible 320 may be disposed in the furnace 300. The furnace 300 may have a port P3 that may be fluidly connected directly to an interior volume of the furnace 300. Within the tray/crucible 320, a metal powder such as silicon may be disposed. Port P3 may include a device 325 to prevent molten metal from being evacuated.

The furnace 300 may be any suitable enclosure capable of generating sufficient heat to melt the metal powder 315. The furnace 300 may include electrical resistance elements and utilize induction and/or direct heating. The furnace 300 may be of a programmable-type capable of carrying out a programmed heating schedule. The furnace 300 may further include a control system (not shown) to monitor an internal temperature in real-time to cycle the heating components as needed to maintain a programmed temperature, for example, using PID control. Furnace 300 may include a port P3 to which pressurizing/depressurizing equipment (not shown) may be attached. For instance, the P3 may be connected to various plumbing and storage tank components to apply a wide range of positive and negative pressures to the furnace 300. For instance, the furnace 300 may be capable of holding pressures ranging between vacuum (s 100 mTorr) to approximately 38 kTorr. Furnace 300 may additionally include a hoist device (not shown) to lower and raise the fiber preform or green body 310 to and from the molten material 315, as will be subsequently described.

The fiber preform or green body 310, metal powder 315, tray/crucible 320, and device 325 may be of similar structure, function, and bear similar relationships to one another as in the description of metal powder 215, tray/crucible 220, and device 225.

Referring back to FIG. 1C, in step 150 of method 3 a negative pressure, preferably a vacuum of 100 mTorr or less, may be applied to the port P3 of the furnace 300. Simultaneously with step 150 or subsequently thereafter, the furnace 300 may begin to heat in step 155 in preparation for melting the metal powder 315. By applying an approximate vacuum, a substantially combustion-free and oxidation-free environment may be established within the interior of the furnace 300. In step 155, it may also be determined that the metal powder 315 has melted. The determination in step 155 may occur, for example, based on user observation, expiration of a predetermined timer value, a thermometer threshold reading, and the like. This step is schematically illustrated in FIG. 3A.

In step 160, the fiber preform/green body 310 may be fully submerged into the molten material 315 bath to allow infiltration of the molten material 315 from all sides of the fiber preform/green body 310. During this time, the furnace 300 may maintain the vacuum applied in step 150. This step is schematically shown in FIG. 3B.

In step 165, the furnace 300 pressure may be increased via port P3 to about 7 PSI to assist with collapsing any dry slurry pockets within the fiber preform/green body 310.

In step 175, the fiber preform/green body 310, now infiltrated with the molten material 315, may be removed from the molten material 315 bath while maintaining the previous increased furnace pressure applied via port P3 in step 165. This step is schematically shown in FIG. 3C.

In step 180, the temperature of the furnace 300 may be allowed to cool. Optionally, a step 181 may occur simultaneously with step 180 and/or during subsequent step 185 where nitrogen and/or ammonia gas may be introduced via the port P3. Introducing the nitrogen and/or ammonia gas may change the wetting angle of the silicon to encourage excess silicon to bread-up and roll from the finished article.

In step 185, the furnace 300 pressure may be increased via port P3 to at least an ambient atmospheric pressure or greater to encourage infiltration of the molten material 315 into the pores of fiber preform/green body 310 while the finished article continues to cool.

The infiltration of the metal or metal alloy may be accomplished at a temperature of at least 1,000° C.; alternatively, about 1,200° C. to about 1,700° C.; alternatively, between about 1,350° C. and about 1,550° C. Following the infiltration of the metal or metal alloy, the CMC article may optionally be machined to form a suitable finished component or article.

The foregoing description, for purpose of explanation, has been described with reference to specific embodiments. However, the illustrative discussions above are not intended to be exhaustive or to limit embodiments of the disclosed subject matter to the precise forms disclosed. Many modifications and variations are possible in view of the above teachings. The embodiments were chosen and described in order to explain the principles of embodiments of the disclosed subject matter and their practical applications, to thereby enable others skilled in the art to utilize those embodiments as well as various embodiments with various modifications as may be suited to the particular use contemplated.

The logic illustrated in the flow diagrams may include additional, different, or fewer operations than illustrated. The operations illustrated may be performed in an order different than illustrated.

To clarify the use of and to hereby provide notice to the public, the phrases "at least one of <A>, <B>, . . . and <N>" or "at least one of <A>, <B>, . . . or <N>" or "at least one of <A>, <B>, . . . <N>, or combinations thereof" or "<A>, <B>, . . . and/or <N>" are defined by the Applicant in the broadest sense, superseding any other implied definitions hereinbefore or hereinafter unless expressly asserted by the Applicant to the contrary, to mean one or more elements selected from the group comprising A, B, . . . and N. In other words, the phrases mean any combination of one or more of the elements A, B, . . . or N including any one element alone or the one element in combination with one or more of the other elements which may also include, in combination, additional elements not listed. Unless otherwise indicated or the context suggests otherwise, as used herein, "a" or "an" means "at least one" or "one or more."

While various embodiments have been described, it will be apparent to those of ordinary skill in the art that many more embodiments and implementations are possible. Accordingly, the embodiments described herein are examples, not the only possible embodiments and implementations.

In addition to the features mentioned in each of the independent aspects enumerated above, some examples may show, alone or in combination, the optional features mentioned in the dependent aspects and/or as disclosed in the description above and shown in the figures.

What is claimed is:

1. A method of melt infiltrating a fiber preform comprising:

providing the fiber preform inside of a pressure vessel, heating a metal powder contained in a crucible to form a molten material, the pressure vessel and crucible being located in a furnace;

simultaneously or prior to the heating, applying a negative pressure to a first port of the furnace and to a second port of the pressure vessel, the pressure vessel projecting into the molten material contained in the crucible, the pressure vessel having an opening located below a surface of the molten material through which the molten material enters the pressure vessel, wherein an end of the fiber preform contacts the molten material within the pressure vessel;

pulling the molten material within the pressure vessel by increasing a first pressure at the first port of the furnace so the first pressure is higher than a second pressure at the second port of the pressure vessel, the second port located above the molten material located within the pressure vessel; and infiltrating the fiber preform with the molten material.

2. The method of claim 1 further comprising:

keeping the first pressure greater than the vapor pressure of the molten material and the second pressure at a vacuum.

3. The method of claim 1 further comprising:

causing a level of the molten material located within the pressure vessel to rise above the fiber preform and cover the fiber preform with the molten material while keeping the first pressure greater than the vapor pressure of the molten material and keeping the second pressure at a vacuum.

4. The method of claim 3 further comprising:

increasing the second pressure at the second port and the first pressure at the first port while the fiber preform is covered with the molten material, wherein the first pressure and the second pressure are increased to at least an ambient atmospheric pressure.

5. The method of claim 4, wherein the first pressure and the second pressure are increased to a matching pressure that is greater than the ambient atmospheric pressure.

6. The method of claim 1 further comprising:

increasing the second pressure applied to the second port; and/or decreasing the first pressure applied to the first port, wherein the first pressure applied to the first port is less than the second pressure applied to the second port.

7. The method of claim 1, wherein the increasing of the first pressure of the furnace via the first port causes the molten material to propagate vertically in the pressure vessel.

8. The method of claim 1 further comprising:

applying a gas comprising nitrogen or ammonia via the first or second port.

9. The method of claim 1 further comprising:

preventing the molten material from being evacuated via the second port or the first port.

10. The method of claim 1, wherein during the step of increasing the pressure applied to the furnace at the first port, the pressure applied to the furnace is increased to meet or exceed a vapor pressure of molten material.

11. The method of claim 5, further comprising:

returning the molten material to a lower height within the pressure vessel in response to increasing the first pressure and the second pressure to the matching pressure.

12. The method of claim 1, wherein the step of increasing the pressure applied to the furnace at the first port further comprises:

increasing the pressure applied to the first port to at least 5 mTorr.

13. A method of melt infiltrating a fiber preform comprising:

providing the fiber preform inside of a pressure vessel, the pressure vessel projecting into a molten material contained in a crucible, the pressure vessel having an opening located below a surface of the molten material through which the molten material enters the pressure vessel, wherein an end of the fiber preform contacts the molten material within the pressure vessel, the pressure vessel and crucible located in a furnace;

pulling the molten material within the pressure vessel vertically higher in the pressure vessel to cover the fiber preform with the molten material by increasing a first pressure at a first port of the furnace so the first pressure is higher than a second pressure at a second port of the pressure vessel and higher than the vapor pressure of the molten material, the second port located above the molten material in the pressure vessel;

increasing the second pressure at the second port and the first pressure at the first port while the fiber preform is covered with the molten material, wherein the first pressure and the second pressure are increased to at least an ambient atmospheric pressure to a matching pressure; and infiltrating the fiber preform with the molten material to react with a portion of the fiber preform and to form a reaction product within the fiber preform.

14. The method of claim 13 further comprising:

increasing the second pressure applied to the second port; and/or decreasing the first pressure applied to the first port, wherein the first pressure applied to the first port is less than the second pressure applied to the second port.

* * * * *